US005323699A

United States Patent [19]

Motoe et al.

[11] Patent Number: 5,323,699

[45] Date of Patent: Jun. 28, 1994

[54] USED STENCIL SHEET DISPOSAL DEVICE

[75] Inventors: Katsuro Motoe; Shigenori Ishii; Takeshi Saitoh, all of Tokyo, Japan

[73] Assignee: Riso Kagaku Corporation, Tokyo, Japan

[21] Appl. No.: 24,759

[22] Filed: Mar. 2, 1993

[30] Foreign Application Priority Data

Mar. 13, 1992 [JP] Japan ..... 4-089385

[51] Int. Cl.[5] ..... B41L 13/06

[52] U.S. Cl. ..... 101/114; 101/116; 101/477

[58] Field of Search ..... 101/114, 116, 120, 118, 101/121, 477, 479; 400/625, 634, 635, 636; 271/6, 7, 12, 34, 66, 67, 69, 198, 264, 307, 311

[56] References Cited

U.S. PATENT DOCUMENTS

| | | | |
|---|---|---|---|
| 4,092,921 | 6/1978 | McInnis | 400/635 |
| 4,134,338 | 1/1979 | Selman | 101/122 |
| 4,542,998 | 9/1985 | Osmera et al. | 400/139 |
| 4,628,813 | 12/1986 | Hasegawa et al. | 101/116 |
| 4,846,057 | 7/1989 | Endo et al. | 101/120 |
| 5,133,919 | 7/1992 | Hasegawa et al. | 101/114 |

FOREIGN PATENT DOCUMENTS

| | | |
|---|---|---|
| 59-96984 | 6/1984 | Japan . |
| 59-143679 | 8/1984 | Japan . |
| 2225078 | 9/1990 | Japan . |
| 569648 | 3/1993 | Japan . |

*Primary Examiner*—Edgar S. Burr
*Assistant Examiner*—Ren Yan
*Attorney, Agent, or Firm*—Stevens, Davis, Miller & Mosher

[57] ABSTRACT

In order to positively dispose of a used stencil sheet from a printing drum of a rotary stencil printer, an endless belt element expanded between one of a pair of used stencil sheet transfer rollers for nipping and transferring a used stencil sheet disposed of from a printing drum and a pulley is positioned to oppose a claw means with a space left therebetween so that a leading end portion of the used stencil sheet detached from the printing drum by the claw means is guided by the endless belt element until it reaches a nip portion of the pair of used stencil sheet transfer rollers.

9 Claims, 2 Drawing Sheets

USED STENCIL SHEET DISPOSAL DEVICE

BACKGROUND OF THE INVENTION

1. Field of the Invention

The present invention relates to the field of stencil printing, and more particularly to a used stencil sheet disposal device for disposing of a used stencil sheet from a printing drum of a stencil printer.

2. Description of the Prior Art

As a used stencil sheet disposal device for disposing of a used stencil sheet from a printing drum of a rotary stencil printer, there is known a device which comprises a claw means having a tip end positioned adjacent a periphery of the printing drum so as to detach the used stencil sheet from the printing drum, and a pair of used stencil sheet transfer rollers positioned behind the claw means as viewed from the printing drum and adapted to rotate in mutually opposite directions in contact with one another, whereby the used stencil sheet is detached from the printing drum by the tip end of the claw means and is nipped by the pair of used stencil sheet transfer rollers which transfer the stencil sheet in a stencil sheet disposal direction.

Such a conventional used stencil sheet disposal device operates satisfactorily to complete the disposal of the used stencil sheet, if a leading end portion of the stencil sheet detached from the printing drum by the tip end of the claw means has once been nipped between the pair of used stencil sheet transfer rollers. However, since the leading end portion of the stencil sheet detached from the printing drum by the claw means is pushed by a succeeding portion of the stencil sheet being detached in a floating condition, it was a problem to be solved how the soft and easily bendable leading end portion of the stencil sheet is conducted without fail to the nip portion of the pair of used stencil sheet transfer rollers. The general approach to this problem in the past was to position the pair of used stencil sheet transfer rollers as close to the claw means as possible so that the leading end portion of the stencil sheet passed over the tip end of the claw means reaches the nip portion of the pair of used stencil sheet transfer rollers as soon as possible. However, there is a limit in positioning the pair of used stencil sheet transfer rollers close to the claw means, and therefore also close to the outer periphery of the printing drum, because of various inconveniences caused thereby in the design of the rotary stencil printer.

SUMMARY OF THE INVENTION

It is therefore the object of the present invention to provide a used stencil sheet disposal device which can positively transfer a leading end portion of the stencil sheet detached from a printing drum by a claw means to a nip portion of a pair of used stencil sheet transfer rollers without fail with no need of positioning the pair of used stencil sheet transfer rollers substantially close to a tip end of the claw means.

According to the present invention, the above-mentioned object is accomplished by a used stencil sheet disposal device for disposing of a used stencil sheet from a printing drum of a rotary stencil printer, comprising a claw means having a tip end positioned adjacent a periphery of the printing drum so as to detach the used stencil sheet from the printing drum, at least one pair of used stencil sheet transfer rollers positioned behind the claw means as viewed from the printing drum and adapted to rotate in mutually opposite directions in contact with one another, and an endless belt means including an expansion pulley means and an endless belt element expanded around the expansion pulley means and one of said pair of used stencil sheet transfer rollers so as to extend in a posture of opposing the tip end of the claw means with a space left therebetween.

By providing such an endless belt means including an expansion pulley and an endless belt element expanded around the expansion pulley means and one of said pair of used stencil sheet transfer rollers so as to extend in a posture of opposing the tip end of the claw means with a space left therebetween, the leading end portion of the stencil sheet detached from the printing drum by the claw means is positively confined between the claw means and the endless belt element, and is positively brought into a nip portion of the pair of used stencil sheet transfer rollers so as to be nipped therebetween as a span of the endless belt element extending to oppose the claw means moves toward the nip portion of the pair of used stencil sheet transfer rollers in synchronization with a rotation of the pair of used stencil sheet transfer rollers.

The endless belt means may comprise a combination of a shaft and a plurality of rollers supported by the shaft in a spaced relation along the shaft with each of such rollers working as one of the pair of used stencil sheet transfer rollers, and the endless belt element may comprise a plurality of separate endless belt elements each expanded around each selected one of the plurality of rollers.

The rollers selected for expanding the endless belt elements may each be formed with a circumferential groove of a depth substantially corresponding to a thickness of the endless belt elements.

The endless belt elements may each have a rectangular cross section, and the circumferential grooves may each have a rectangular cross section substantially corresponding to the cross section of the mating endless belt element.

Or, the endless belt elements may each have a circular cross section, and the circumferential grooves may each have a cross section composed of a semi-circular bottom portion and a half square opening portion. In this case, the diameter of the endless belt element may be slightly larger than the total depth of the semi-circular bottom portion and the half square opening portion.

The rollers selected for expanding the endless belt elements may be positioned alternately with the rollers not selected for expanding the endless belt elements.

The expansion pulley means may comprise a combination of a shaft and a plurality of pulleys supported by the shaft with each one of the pulleys expanding a corresponding one of the separate endless belt elements.

The endless belt means may comprise a framework including a pair of arm members each supported at a first end portion thereof to be rotatable about a central axis of one of the pair of used stencil sheet transfer rollers and a connection member firmly connecting second end portions of the pair of arm members opposite to the first end portions thereof, and the expansion pulley means may be rotatably supported by the framework to be rotatable therewith about the central axis of one of the pair of used stencil sheet transfer rollers.

BRIEF DESCRIPTION OF THE DRAWINGS

In the accompanying drawings.

DESCRIPTION OF THE PREFERRED EMBODIMENTS

In the following the present invention will be described in detail with respect to a preferred embodiments thereof with reference to the accompanying drawing.

Figure 1:
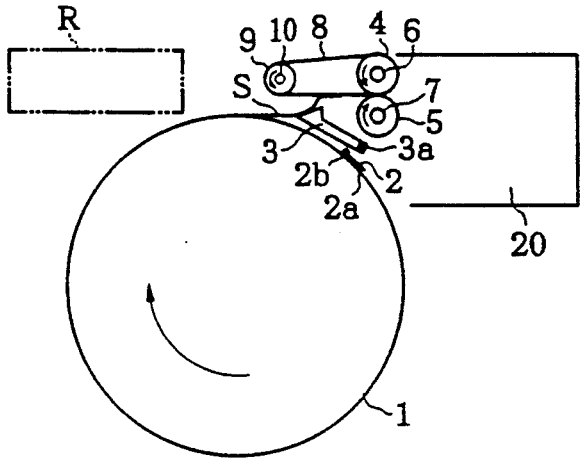
FIG. 1 is a diagrammatical side view showing an embodiment of the used stencil sheet disposal device according to the present invention together with a printing drum of a rotary stencil printer.

Referring to FIG. 1 showing in a diagrammatical side view an embodiment of the used stencil sheet disposal device according to the present invention together with a printing drum of a rotary stecil printer, the printing drum designated by reference numeral 1 is adapted to bear a stencil sheet therearound and to rotate in the direction shown by an arrow during printing and also during disposal of a used stencil sheet from the printing drum. The basic constructions of such a rotary stencil printer and its printing drum are well known in the art. Various improvements with respect to the detailed constructions of the printing drum have been proposed heretofore by patent and utility model applications, one such improvement being disclosed in Japanese Patent Laid-open Publication 2-225078 (1990) based upon an application filed by the same assignee as the present application. The printing drum 1 in the shown embodiment may have the construction of the printing drum disclosed in the Publication 2-225078, although the detailed construction of the printing drum is not particularly concerned with the invention of the present application.

The printing drum 1 is provided with a clamp means 2 for holding a leading edge of a stencil sheet mounted therearound. Various proposals have also been made with respect to such a clamp means by patent and utility model applications. Although the detailed construction of the clamp means is again not particularly concerned with the invention of the present application, the clamp means 2 in the shown embodiment may have the construction of the clamp means disclosed in Japanese Patent Laid-open Publication 59-96984 (1984) based upon an application filed by the same assignee as the present application, or the construction of the clamp means disclosed in Japanese Patent Laid-open Publication 3-26102 (1991) based upon an application filed by the same assignee as the present application, the latter proposing a further improvement of the formerly proposed clamp means. The clamp means 2 in the shown embodiment comprises a clamping flap 2*a* adapted to turn about a pivot shaft 2*b* 180 degrees to be switched between its clamp position to press a leading edge of a stencil sheet onto the printing drum and its unclamped position turned 180 degrees therefrom to release the leading edge of the stencil sheet.

A claw means 3 is mounted adjacent the printing drum 1 to be pivotable about a pivot shaft 3*a* which supports the claw means at a root portion thereof. The pivot shaft 3*a* is supported by a supporting member, not shown in the figure, mounted in the housing of the stencil printer. In the state shown in the figure, the clamp means 2 is switched to its unclamped position, and the claw means 3 is turned about the pivot shaft 3*a* so as to position its tip end close to the peripheral surface of the printing drum, so that a used stencil sheet S wrapped around the printing drum is detached therefrom, starting from the leading edge thereof by the detaching action of the claw means 3.

Figure 2:
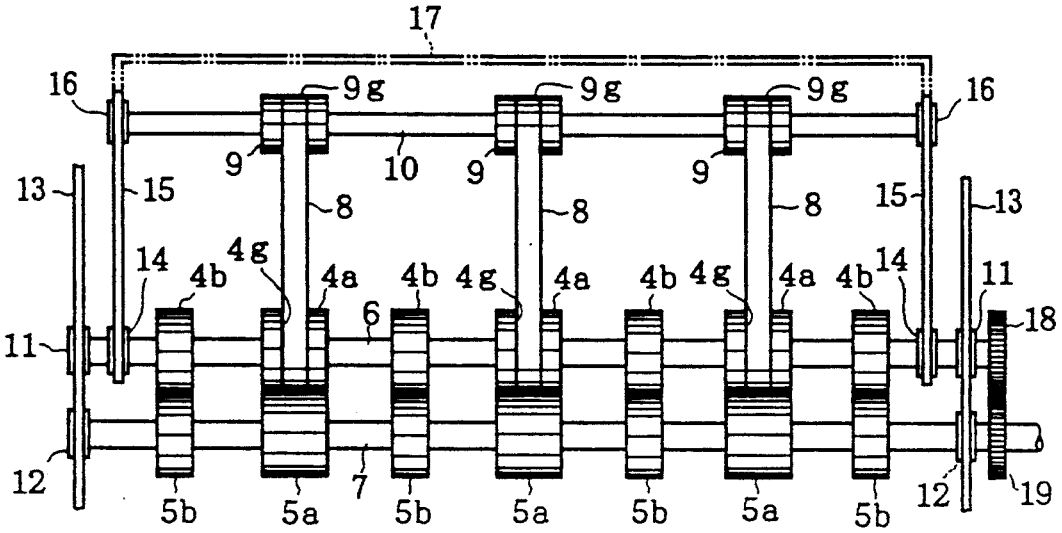
FIG. 2 is a view showing an essential portion of the used stencil sheet disposal device shown in FIG. 1 as viewed from an upper right position in FIG. 1 and partially developed.

A pair of used stencil sheet transfer rollers 4 and 5 are provided at a position to the rear of the claw means 3 as viewed from the printing drum 1, so as to be rotatable in mutually opposite directions in contact with one another. In the shown embodiment, the used stencil sheet transfer rollers 4 and 5 are individually made of a plurality of rollers mounted on shafts 6 and 7 as spaced therealong, respectively, as shown in FIG. 2. Several pairs of rollers such as pairs of rollers 4*a* and 5*a* are wider than other pairs of rollers such as 4*b* and 5*b*, and the wider rollers 4*a* bear individually endless belt elements 8. Each roller 4*a* has a circumferential groove 4*g* along a center of the width thereof, the groove having a width and a depth substantially corresponding to the width and the thickness of the endless belt element 8, so that the roller 4*a* and the endless belt element 8 engaged in the groove to be guided thereby present a generally smooth cylindrical outer surface in an area where they contact with the mating roller 5*a*.

In more detail, in the embodiment shown in FIG. 2, the endless belt element 8 has a rectangular cross section, while the circumferential groove 4*g* has a correspondingly rectangular cross section, so that, when the endless belt element 8 is fully engaged in the circumferential groove 4*g*, an almost perfectly cylindrically curved surface is available by the combination of the outer surfaces of the roller 4*a* and the endless belt element 8.

Figure 3:
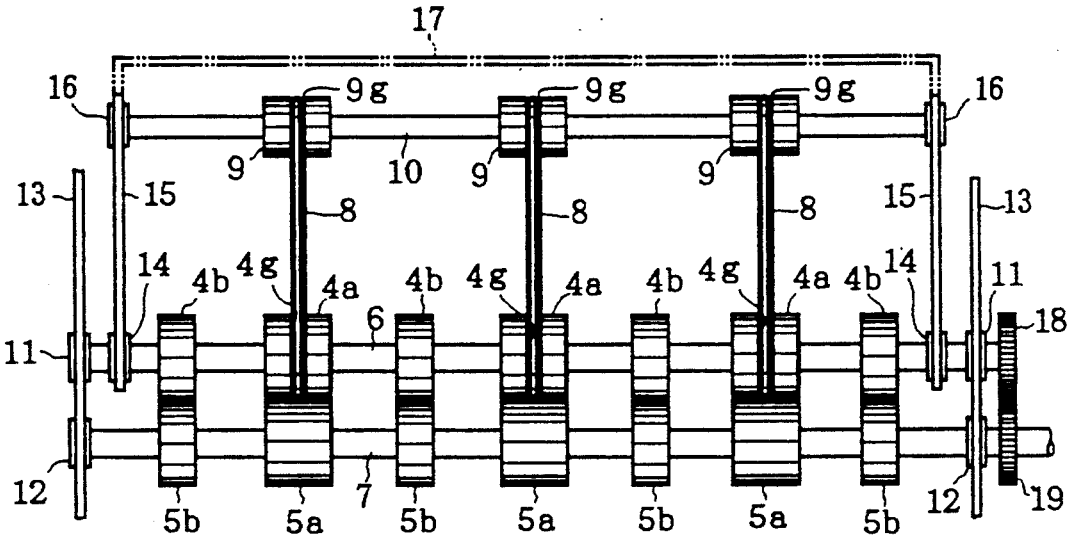
FIG. 3 is a view similar to FIG. 2, showing another embodiment with respect to the cross sectional configuration of the endless belt elements and the circumferential grooves formed in the rollers.

On the other hand, in the embodiment shown in FIG. 3, the endless belt 8 has a circular cross section, while the circumferential groove 4*g* has a cross section composed of a semi-circular bottom portion and a half square opening portion, so that, when the endless belt 8 is fully engaged in the circumferential groove 4*g*, the endless belt element 8 is neatly seated on the semi-circular bottom portion of the circumferential groove 4*g* at its inside half peripheral surface, while presenting a circular convex outer surface housed in the half square opening portion with its ridgeline reaching the opening end of the half square opening portion along a center line thereof. In this embodiment, when the diameter of the endless belt element 8 is slightly larger than the sum of the depth of the semi-circular bottom portion and that of the half square opening portion, a narrow area along the ridgeline of the endless belt element 8 is raised from the cylindrical configuration of the roller 4*a*. Such a structure provides a particular advantage that the stencil sheet is more distinctly nipped along a plurality of such parallelly arranged raised ridgeline portions of the endless belt elements 8, so that the used stencil sheet is more stably transferred along a center line of the used stencil sheet disposal device, i.e. a straight line perpendicular to the axes of the rollers 4 and 5.

The endless belt elements 8 are each supported by a corresponding one of a plurality of pulleys 9 at a position remote from the rollers 4*a*, wherein the pulleys 9 provide an expansion pulley means for expanding the endless belt elements 8 relative to the rollers 4*a*. The pulleys 9 are each also formed with a circumferential groove 9g having a width and a depth substantially corresponding to the width and the thickness of the endless belt element 8 along a center of the width thereof to receive the endless belt element 8 therein. The circumferential grooves 9g are also formed to have a rectangular cross section or a combination of a semicircular bottom portion and a half square opening portion in the embodiment shown in FIG. 2 or 3, respectively, in the same manner as described with respect to the grooves 4g.

The pulleys 9 are mounted on a shaft 10 to be supported thereby. The pulleys 9 and the shaft 10 construct an expansion pulley means for expanding the endless belt elements 8, so as to provide an endless belt means having the endless belt elements 8 arranged to extend in a posture of opposing the tip end of the claw means 3. By such a plurality of separate used stencil sheet transfer rollers 4a and correspondingly separate endless belt elements 8 being expanded in parallel as spaced over the width of the endless belt means, the contamination of the endless belt means inevitably caused due to the direct contact with the ink bearing surface of the used stencil sheet, i.e. the amount of ink transferred thereto from the used stencil sheet, is minimized, while ensuring a highly stable guiding performance available by the endless belt means according to the present invention, with no undesirable too strong adhesion of the used stencil sheet to the endless belt means. The expansion pulley means may be an integral roll member having no discrimination between the pulleys 9 and the shaft 10. Further, such a roll member need not be formed with the grooves for receiving the endless belt elements 8.

The shafts 6 and 7 are rotatably supported at opposite ends thereof by a housing 13 of the rotary stencil printer via bearing means 11 and 12, respectively. A pair of arm members 15 are rotatably supported at one ends thereof by the shaft 6 via bearing means 14. The shaft 10 is rotatably supported by the arm members 15 at other ends thereof via bearing means 16. The pair of arm members 15 are firmly connected with one another by a connection member 17, whereby the shaft 10 is maintained in parallel with the shaft 6. The framework formed of the pair of arm members 15 and the connection member 17 is selectively moved by an actuating means, not shown in the figure, between an operative position shown in FIG. 1 where the span portions of the endless belt elements 8 expanded between the rollers 4a and the pulleys 9 are positioned to oppose the tip end of the claw means 3 with a space left therebetween and a non-operative position turned about the shaft 6 in the clockwise direction as viewed in FIG. 1 away from the position shown in FIG. 1 so that the span portions of the endless belt elements 8 are retracted away from the printing drum 1. However, the shaft 10 may be directly mounted to the housing 13 via the bearing means 16, instead of being supported by the arm members 15.

Further, although not shown in detail in the figure, in a stencil perforating and printing device including a stencil perforating means R at an upper left position of the printing drum 1 as viewed in FIG. 1, the left end of the endless belt element 8 may extend up to a vicinity of the stencil perforating means R, so that a guide means for the leading edge of a stencil sheet perforated in the stencil perforating means R is available during a transfer thereof toward the clamp means 2, in a manner of applying a guiding action to the leading edge of the stencil sheet from an upper side thereof. In such a construction, the shaft 10 may also be mounted directly to the housing 13 via the bearing means 16, instead of being supported by the arm members 15. A detailed construction of the stencil perforating means R is shown in Japanese Patent Laid-open Publication 59-143679 (1984).

A pair of mutually meshing gear wheels 18 and 19 are mounted at one ends of the shafts 6 and 7, respectively, so that when the shaft 7 is rotated in the clockwise direction in FIG. 1, the shaft 6 is rotated in the anticlockwise direction in synchronization.

When a used stencil sheet S is disposed of from the printing drum 1, a leading end portion of the stencil sheet S released from the clamping action of the clamp means 2 turned to its unclamp position is detached from the printing drum by the tip end of the claw means 3 in a manner shown in FIG. 1 as the printing drum rotates in the clockwise direction, and when the printing drum further rotates, the leading end portion of the stencil sheet is guided by the lower span portions of the endless belt members 8 toward the nip portion of the rollers 4 and 5 as the lower span portions of the endless belt elements moves in the same direction as the moving direction of the leading end portion of the stencil sheet according to the rotation of the printing drum. The stencil sheet is then further nipped and transferred by the rollers 4 and 5 to be received in a disposal chamber 20.

As will be appreciated from the foregoing descriptions, when the used stencil sheet disposal device according to the present invention is employed, the leading end portion of the stencil sheet detached from the printing drum by the claw means is positively guided by the endless belt element moving in the same direction as the leading end portion of the stencil sheet until it reaches the nip portion of the pair of used stencil sheet transfer rollers. Since the pair of used stencil sheet transfer rollers may be positioned substantially apart from the printing drum, high freedom is available in the design of the used stencil sheet transfer rollers. When the pulley support structure composed of the arm members 15 and the connection member 17 is rotatable about the shaft 6 between its operative position and its non-operative position as in the embodiment shown in the figure, high freedom is also available in the design of the printer around the printing drum.

When the endless belt elements 8 extend up to a vicinity of the stencil perforating means R so as to operate in relation therewith, the used stencil sheet disposal device according to the present invention operates also as a means for guiding a perforated stencil sheet to assist the mounting of the perforated stencil sheet to the printing drum.

Although the invention has been described in detail in the above with respect to a preferred embodiment thereof, it will be apparent for those skilled in the art that various modifications are possible within the scope of the present invention.

We claim:

1. A used stencil sheet disposal device for disposing of a used stencil sheet from a printing drum of a rotary stencil printer, comprising a claw means having a tip end positioned adjacent a periphery of the printing drum so as to detach the used stencil sheet generally upwardly from the printing drum, at least one pair of used stencil sheet transfer rollers positioned behind the claw means as viewed from the printing drum having central areas thereof arranged horizontally and displaced vertically from one another and adapted to rotate in mutually opposite directions and in contact with one another, and an endless belt means including an expansion pulley means and an endless belt element extending around the expansion pulley means and an upper one of said pair of used stencil sheet transfer rollers so as to be positioned above and spaced from the tip end of the claw means.

2. A used stencil sheet disposal device according to claim 1, wherein the endless belt means comprises a combination of a shaft and a plurality of rollers supported by the shaft in a spaced relation along the shaft with each of such rollers working as the upper one of the pair of used stencil sheet transfer rollers, and the endless belt element comprises a plurality of separate endless belt elements each extending around one of the plurality of rollers.

3. A used stencil sheet disposal device according to claim 2, wherein the rollers supporting the endless belt elements are each formed with a circumferential groove of a depth substantially corresponding to a thickness of the endless belt elements.

4. A used stencil sheet disposal device according to claim 3, wherein the endless belt elements have each a rectangular cross section, and the circumferential grooves have each a rectangular cross section substantially corresponding to the cross section of the endless belt elements.

5. A used stencil sheet disposal device according to claim 3, wherein the endless belt elements have each a circular cross section, and the circumferential grooves have each a cross section including a semicircular bottom portion and a half square opening portion.

6. A used stencil sheet disposal device according to claim 5, wherein the diameter of the cross-section of the endless belt element is slightly larger than the total depth of the semi-circular bottom portion and the half square opening portion.

7. A used stencil sheet disposal device according to claim 2, wherein the plurality of rollers of the endless belt means includes some rollers which do not support any one of the endless belt elements.

8. A used stencil sheet disposal device according to claim 2, wherein the pulley means comprises a combination of a shaft and a plurality of pulleys supported by the shaft with each one of the pulleys supporting a corresponding one of the separate endless belt elements.

9. A used stencil sheet disposal device according to claim 1, wherein the endless belt means comprises a framework including a pair of arm members each supported at a first end portion thereof to be rotatable about a central axis of the upper one of the pair of used stencil sheet transfer rollers and a connection member firmly connecting second end portions of the pair of arm members opposite to the first end portions thereof, and the expansion pulley means is rotatably supported by the framework to be rotatable therewith.

* * * * *